US008925158B2

(12) United States Patent
Fried

(10) Patent No.: US 8,925,158 B2
(45) Date of Patent: Jan. 6, 2015

(54) RELEASABLE PULL TIE

(71) Applicant: Brian A Fried, Melville, NY (US)

(72) Inventor: Brian A Fried, Melville, NY (US)

( * ) Notice: Subject to any disclaimer, the term of this patent is extended or adjusted under 35 U.S.C. 154(b) by 0 days.

(21) Appl. No.: 13/776,676

(22) Filed: Feb. 25, 2013

(65) Prior Publication Data

US 2013/0167329 A1 Jul. 4, 2013

Related U.S. Application Data

(63) Continuation-in-part of application No. 12/544,208, filed on Aug. 19, 2009, now abandoned.

(60) Provisional application No. 61/093,659, filed on Sep. 2, 2008.

(51) Int. Cl.
*B65D 33/16* (2006.01)
*F16G 11/10* (2006.01)

(52) U.S. Cl.
CPC ..... *B65D 33/1633* (2013.01)
USPC ..... 24/115 G; 24/115 H; 24/122.6; 24/136 R; 24/30.5 R

(58) Field of Classification Search
CPC ..... F16G 11/10; F16G 11/14; A43C 7/00; A43C 7/06; B63B 21/04
USPC ..... 24/30.5 L, 30.5 P, 115 R, 122.6, 136 R, 24/136 A, 115 M, 30.5 R; 383/76, 71
See application file for complete search history.

(56) References Cited

U.S. PATENT DOCUMENTS

| | | | | | |
|---|---|---|---|---|---|
| 4,328,605 | A * | 5/1982 | Hutchison et al. | 24/115 G |
| 4,453,292 | A * | 6/1984 | Bakker | 24/115 G |
| 4,675,948 | A * | 6/1987 | Bengtsson | 24/115 G |
| 4,881,302 | A * | 11/1989 | Lee | 24/136 R |
| 5,131,290 | A * | 7/1992 | Atkinson | 74/558.5 |
| 5,440,788 | A * | 8/1995 | Boden | 24/115 H |
| 5,465,466 | A * | 11/1995 | Napier | 24/3.3 |
| 5,611,118 | A * | 3/1997 | Bibbee | 24/298 |
| 5,657,557 | A * | 8/1997 | Hull et al. | 36/58.5 |
| 5,697,128 | A * | 12/1997 | Peregrine | 24/115 G |
| 5,765,227 | A * | 6/1998 | Wright | 2/144 |
| 5,896,623 | A * | 4/1999 | Martin | 24/16 PB |
| 6,189,186 | B1 * | 2/2001 | Boden | 24/129 R |
| 6,449,810 | B1 * | 9/2002 | Kuwayama | 24/115 H |
| 6,460,226 | B1 * | 10/2002 | Smith et al. | 24/115 R |
| 6,675,446 | B2 * | 1/2004 | Buettell | 24/122.6 |
| 6,973,744 | B2 * | 12/2005 | Curet | 36/50.1 |
| D560,480 | S * | 1/2008 | Tamura et al. | D8/383 |
| 7,337,503 | B1 * | 3/2008 | Ashbrook | 24/115 G |
| 7,574,779 | B2 * | 8/2009 | Takahashi | 24/136 L |
| 8,033,728 | B1 * | 10/2011 | Shatwell | 383/71 |
| 2003/0037416 | A1 * | 2/2003 | Buettell | 24/122.6 |
| 2005/0166369 | A1 * | 8/2005 | Takahashi | 24/136 R |
| 2006/0179619 | A1 * | 8/2006 | Pearce et al. | 24/136 R |
| 2006/0209533 | A1 * | 9/2006 | Druzin | 362/108 |
| 2007/0022575 | A1 * | 2/2007 | Takahashi | 24/136 R |
| 2009/0144944 | A1 * | 6/2009 | Chen | 24/30.5 L |

* cited by examiner

*Primary Examiner* — Robert J Sandy
*Assistant Examiner* — Rowland Do

(57) ABSTRACT

A pull tie is described having an elastomeric cord and a slidable stop. The pull tie can be suitable for releasable, multi-use closures for flexible bags and containers. The pull tie can be opened and closed with one hand.

19 Claims, 6 Drawing Sheets

RELEASABLE PULL TIE

CROSS REFERENCE TO RELATED APPLICATIONS

This application claims priority to U.S. Patent Appl. Ser. No. 61/093,659, "Releasable Pull Tie," filed Sep. 2, 2008, which is hereby incorporated by reference in its entirety for all purposes.

This application is a Continuation in Part of U.S. application Ser. No. 12/544,208 filed 19 Aug. 2009; entitled "Releasable Pull Tie". The entire contents being hereby incorporated by reference and for which benefit of the priority date is claimed.

FIELD OF THE INVENTION

This invention pertains to releasable, multi-use closures for flexible bags and containers. In particular, this invention pertains to releasable pull ties for closing flexible bags.

DESCRIPTION OF RELATED ART

Plastic bags used for numerous items of food require reusable closure means to allow the food to repeatedly be opened and closed. The ubiquitous "wired paper twist tie" used for freezer bags, plastic bags, loafs of bread, etc., has a number of limitations, as do other approaches such as clamps, plastic clips, including those with a notch for receiving the flexible material of a bad, and related devices. Twist ties and other closures may easy to lose, for example, and sometimes require high levels of dexterity to use or force. Existing closures also may not provide tight seals. Further, currently known methods tend to be unattractive and in some cases are not useful for many repeat uses.

In light of the limitations of prior solutions, there is a need for an improved plastic bag closure that can be repeatedly used and provide effective closure. There is also a need for an improved bag closure that can provide a highly effective tight seal to protect the contents. Further, there is a need for a bag closure that is easy to use even for persons with limited mobility or dexterity. Again, there is a need for improved aesthetics in bag closures.

In mentioning the above unmet needs, it is not to be assumed that any one aspect of the invention must necessarily meet all or any of these particular needs, which are cited simply by way of providing background information pertaining to some aspects of the invention. Likewise, any advantages hereafter described need not pertain to all aspects of the invention, and should not be used to limit the scope of the invention as claimed.

SUMMARY

An improved bag closure has been developed comprising an elastomeric cord in a loop configuration having a bend and two side legs, further comprising a slidable lock that engages each of the legs to form a closed loop between the slidable lock and the bend. The loop can receive a portion of a plastic bag or other flexible container or object to be secured, wherein the slidable lock can then be slid toward the bend to engage the portion of the plastic bag (or other object) enclosed by the loop. The slidable lock has biasing means that urge a portion of the lock against the elastomeric cord to grip the elastomeric cord (e.g., to clamp down on the elastomeric cord) and help prevent the lock from slipping relative to the elastomeric cord in use. A bias release can be activated to allow the slidable lock to be moved to a new position relative to the cord.

In operation, the slidable lock will typically be moved between two general positions, an open position and a closed position, though these need not be fixed locations but can vary depending upon the material being closed and the variable operation of the user, for the slidable lock may be able to assume a broad range of locations along the elastomeric cable. In the open position, the slidable lock is remote from the bend, and the length of the elastomeric cable between the lock and the bend provides a loop that can be readily expanded with the fingers to receive an object such as a plastic bag. Then, the lock may be slid into a closed position to compress the bag in the loop and create a snug closure.

The bag can be opened using a compression force or a tension force. It can also be closed using a compression force or a tension force. This is enabled by the rigidity of the loops.

Thus, the bag closure of the present invention provides a closure that can securely enclose an portion of a flexible bag (typically the mouth thereof) such as a plastic bag by placing a portion of the flexible container through the loop formed by the elastomeric cord and the slidable lock. This is done while the lock is in a first position remote from the bend of the elastomeric cord, followed by sliding the slidable lock to a second position relatively closer to the bend than in the first position, wherein the size of the loop is reduced and the portion of the flexible bag extending through the loop is constricted into a sealed or closed configuration.

Thus, in one embodiment, the present invention comprises a pull tie for releasably closing flexible containers comprising an elastomeric cord substantially in a U-shape having a bend from which both a first leg and a second leg extend, the first and second legs being held in place with a releasable slidable lock, the slidable lock comprising a body having one or more openings to receive the first and second legs of the elastomeric cord, a depressible plunger comprising at least one bore to receive the legs of the elastomeric cord within the body of the slidable lock, bias means that urge the plunger into a locking position such that the elastomeric cord is gripped by the slidable lock, wherein depressing the depressible plunger reduces the gripping of the elastomeric cord by the slidable lock and allows the slidable lock to be moved relative to the elastomeric cord, wherein the portion of the elastomeric cord between the slidable lock and the bend defines a loop that can receive a portion of a flexible container.

The flexible bags that may be closed with the bag closure of the present invention include bags containing food products such as bread bags; plastic produce bags containing fruits, vegetables, bulk goods, and the like; mesh bags such as mesh bags for oranges; paper bags, metalized foil bags, gift bags, resealable bags, bags used to market lettuce leaves and other salad ingredients, snack bags such as those used to package potato chips, candy, trash bags, bags containing medical articles or medical waste, bags for forensic samples, sample bags, money bags, etc.

Bags and other objects that may be used with the present invention may be made of flexible films such as plastic films, multilayer films, cloth, paper, metallic foil, metal mesh, foams, laminates and composite materials, leather, rubber, simulated leather or rubber, and the like The bag closures of the present invention need not be limited to flexible bags in use, but can be used for a variety of purposes such as closing, grasping, pinching, restraining, or joining a variety of objects including containers, items of clothing, gift items, toys, camping supplies such as tents, screens. For example, the bag closure may be used to temporarily join two or more items such as two socks, or may be used to hold one or more items in place, such as holding a curtain or flexible screen in an open position. The closures may also be used to hold bundled hair or other filamentous objects (e.g., similar to a "scrunchie" as described in U.S. Pat. No. 5,301,696, "Decorative Pony Tail Holder and Method of Using," issued Apr. 12, 1994 to R. Revson, or other hair retainers) or as a decorative attachments that can be placed on a variety of objects.

In some embodiments of the present invention, the elastomeric cord has substantial rigidity such that it can maintain its shape regardless of orientation (i.e., the influence of gravity has substantially little influence on the shape assumed by the elastomeric cord, particular when the slidable lock is present). Unlike the highly flexible cords in slidable lanyards used to hold name badges or cord locks used on cords attached to clothing, luggage, or other items, the elastomeric cords of the present invention generally have substantially rigidity such that they hold their shape. This can be achieved both through the material type and the diameter or cross-sectional size and shape of the elastomeric cord. In some embodiments, the elastomeric cord has been molded or formed into a U-shape such that the elastomeric cord retains the U-shape even in the absence of the slidable lock. Alternatively, the shape of the loop between the slidable lock and the bend of the elastomeric cord may be substantially maintained regardless of the orientation of the pull tie in earth's gravitation field, due to the resilience of the elastomeric cord.

BRIEF DESCRIPTION OF DRAWINGS

FIG. 1 displays an embodiment of the invention

DETAILED DESCRIPTION

Figure 1A:
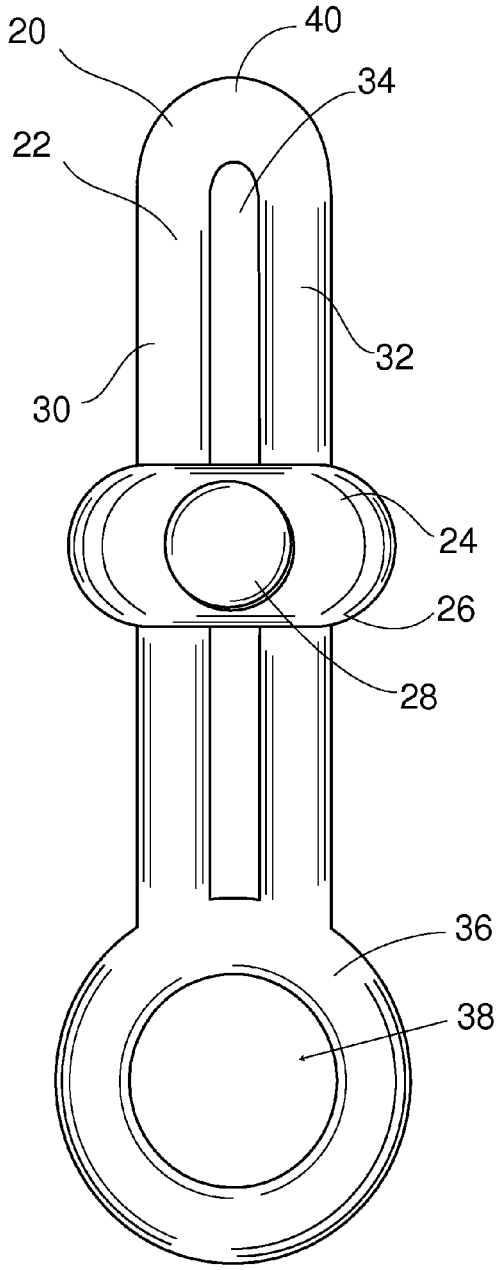
FIGS. 1A and 1B show an embodiment of the pull tie of the present invention with the sliding lock in two alternate positions.
Figure 1B:
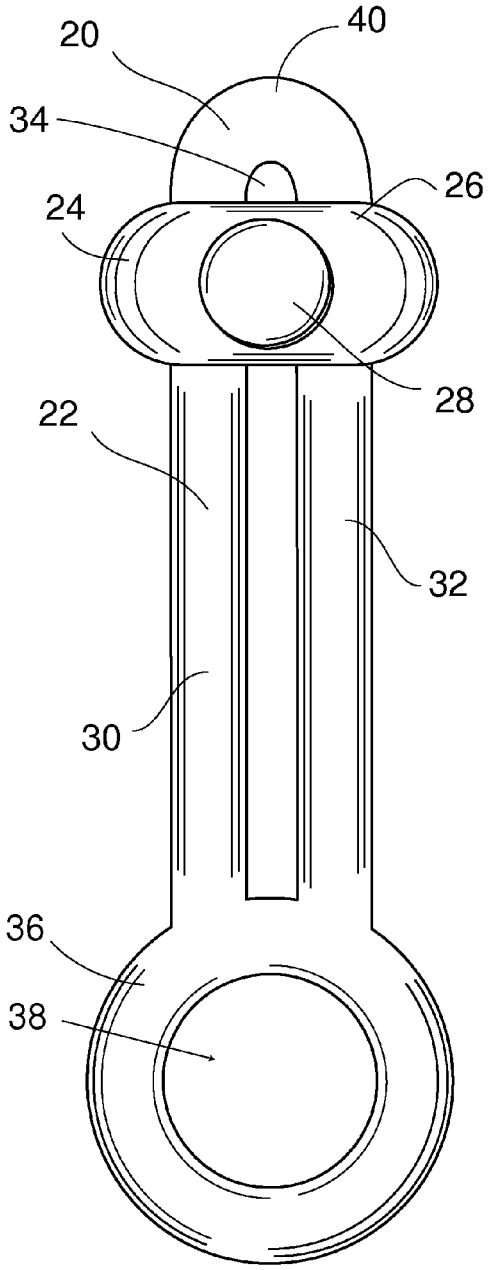

FIGS. 1A and 1B show an embodiment of the pull tie 20 of the present invention. A deformable, resilient elastomeric cord 22 is provided substantially in a U-shape defined by a bend 40 from which descends a first leg 30 and a second leg 32 of the elastomeric cord 22. The legs 30, 32 of the elastomeric cord 22 are engaged (and, in some embodiments, held in place) with a slidable lock 24 comprising a body 26 through which the elastomeric cord 22 passes and a depressible plunger 28, here visible as an external button that can be depressed. Not visible from this perspective are at least one internal bore within the depressible plunger 28 that receives the legs 30, 32 of the elastomeric cord 22. Also not shown is bias means such as an internal spring between the lower surface of the slidable lock body 26 and the depressible plunger 28 that urges the depressible plunger 24 upward to grip the elastomeric cord 22 and prevent relative motion of the slidable lock 24 and the elastomeric cord 22. The terminal portions of the legs 30, 32 of the elastomeric cord 22 are joined by a bridging member 36, here shown as a circle or loop with an interior hole 38 that can be readily gripped by fingers. The bridging member 36, which acts as a lock retention means to keep the slidable lock 24 from undesired separation from the elastomeric cord 22, could have any desired alternate shape (not shown) and need not define a loop. Likewise, the bridging member 36 need not comprise elastomeric material and may be a section of flexible or rigid material such as a plastic strip or rod, a filament, a metal band, etc. The bridging member 36 can also be much thinner or smaller than shown, and may, for example, comprise a section of adhesive material joining the elastomeric cord 22, and in some embodiments may be unitary with the elastomeric cord 22. The bridging member 36 may comprise a thermal or ultrasonic bond joining the legs 30, 32 together, or other attachment means, or may be the result of fusion (not shown) of the two legs 30, 32 into a single element of the elastomeric cord 22.

In FIG. 1A, the slidable lock is at an intermediate position with a relatively large loop 34 defined between the bend 40 and the two substantially parallel descending legs 30, 32 of the elastomeric cord 22 above the slidable lock 24. In FIG. 1B, the slidable lock 24 has been moved to a higher position defining a much smaller loop 34. In this latter position, a flexible bag (not shown) within the loop 34 could be tightly closed and held in a sealed position by the snug grip of the slidable lock 24 against the elastomeric cord 22. When the user (not shown) wishes to release the pull tie 20 and open the bag (not shown), the depressible plunger 28 could be depressed to release the grip of the slidable lock 24, and the slidable lock 24 could then be slid to a lower position on the pull tie, more remote from the bend 40.

Figure 2:
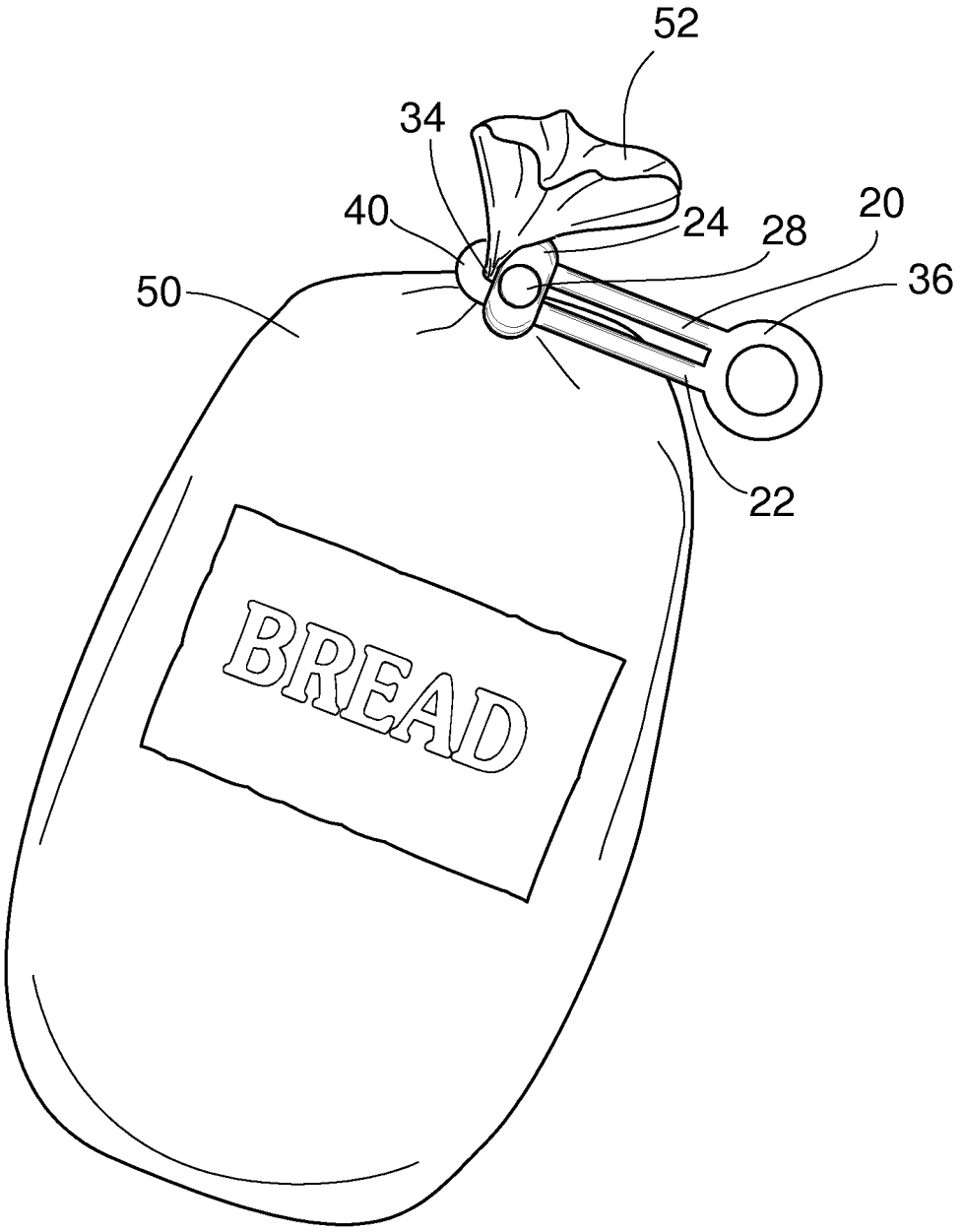
FIG. 2 shows a food bag closed with a pull tie.

FIG. 2 shows a food bag 50 closed with a pull tie 20. Here a bread bag is shown, such as thin, transparent polymeric commonly used for commercial bread. Rather than using a twist tie to seal it, the bag 50 is closed securely with the pull tie 20. The closure was achieved by placing the end 52 of the bag 50 through a loop 34 of the pull tie 20 and then moving the slidable lock 24 toward the bend 40 of the elastomeric cord 22 of the pull tie 20 to cinch the pull tie 20 in a closed position as shown, thereby closing and securing the bag 50. When a user wishes to open the bag 50, the pull tie 20 is readily and quickly opened by depressing the depressible plunger 28 and sliding the slidable lock 24 back toward the circular bridging member 36 of the pull tie 20, or otherwise sliding the slidable lock 24 away from the bend 40.

Figure 3:
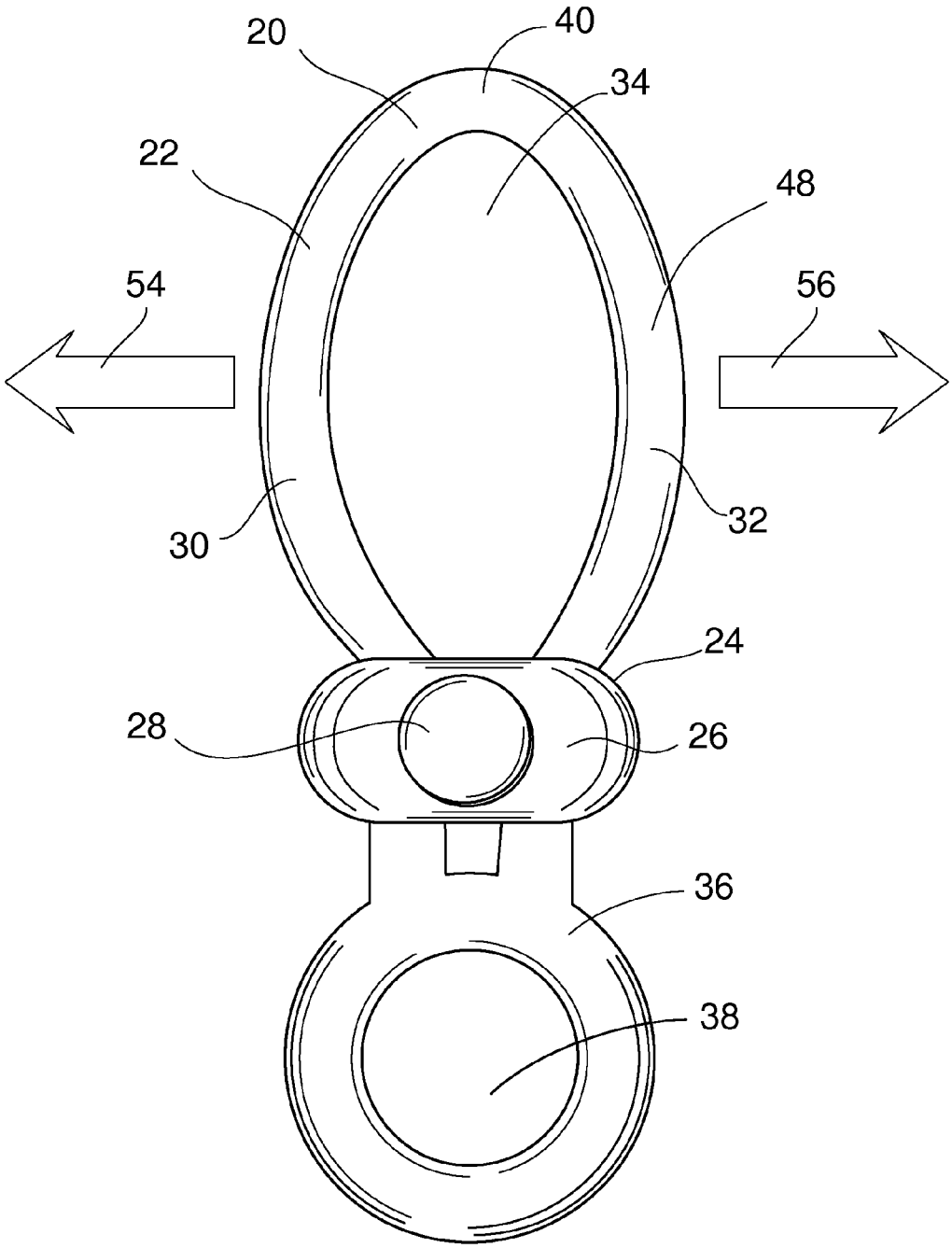
FIG. 3 depicts the deformation of the pull tie loop that may be manually achieved before inserting a bag into the loop prior to cinching the pull tie into a closed position.

FIG. 3 depicts a pull tie 20 and shows the deformation of the pull tie loop 34 that may be manually achieved before inserting a bag into the loop 34 prior to cinching the pull tie 20 into a closed position. The loop 34 may be enlarged, for example, to receive a bag or other object (not shown) by pulling laterally on the legs 30 and 32 in the respective directions shown by arrows 54 and 56, especially when the slidable lock 24 is relatively near the bridging member 36 and relatively remote from the bend 40 of the elastomeric cord 22. In many embodiments, in the absence substantial lateral force, the resilient nature of the elastomeric cord will tend to urge the legs 30, 32 back into a substantially parallel position (not shown here, but see FIGS. 1A and 1B), defining a U-shape in the upper section 48 of the pull-tie 20 above the slidable lock 24. In many embodiments, the shape of the elastomeric cord 22 will tend to be relatively insensitive to gravity, allowing the shape to be retained regardless of orientation in earth's gravity field.

Figure 4:
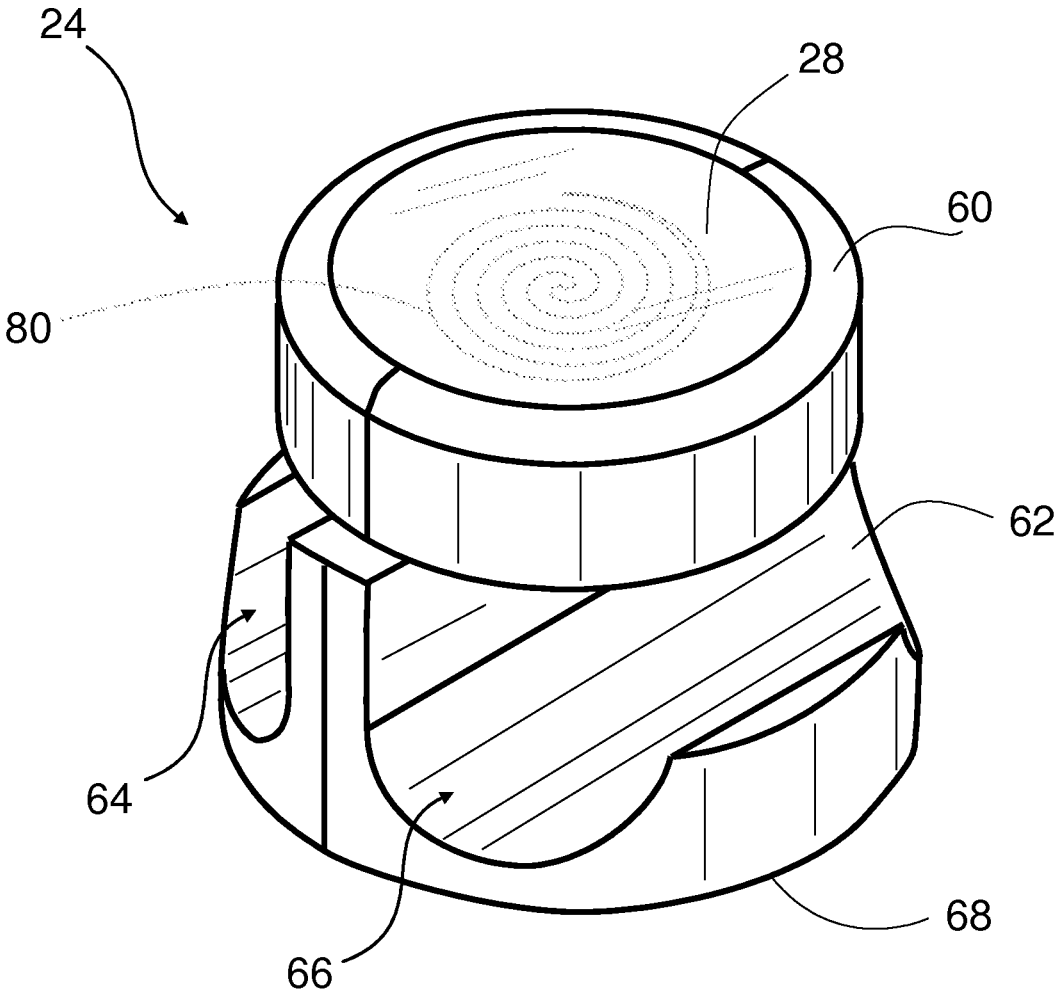
FIG. 4 depicts a portion of a slidable lock.

FIG. 4 depicts a portion of one embodiment of a slidable lock 24 showing a depressible plunger 28 encased in a plunger housing 60 cooperatively associated with an internal body member 62 which helps define two bores 64 and 66 each for receiving a leg (not shown) of an elastomeric cord (not shown). A bias means 80, here depicted as a spring, is beneath the surface of the depressible plunger 28. Not shown are external body members or casements that define a portion of the outer surface of the slidable lock which engage with the depressible plunger 28 and internal body member 62. The lower surface 68 of the internal body member 62 may be exposed and act as an external surface of the slidable lock 24, or it may be covered completely or in part by an external body members or casement (not shown).

Figure 5:
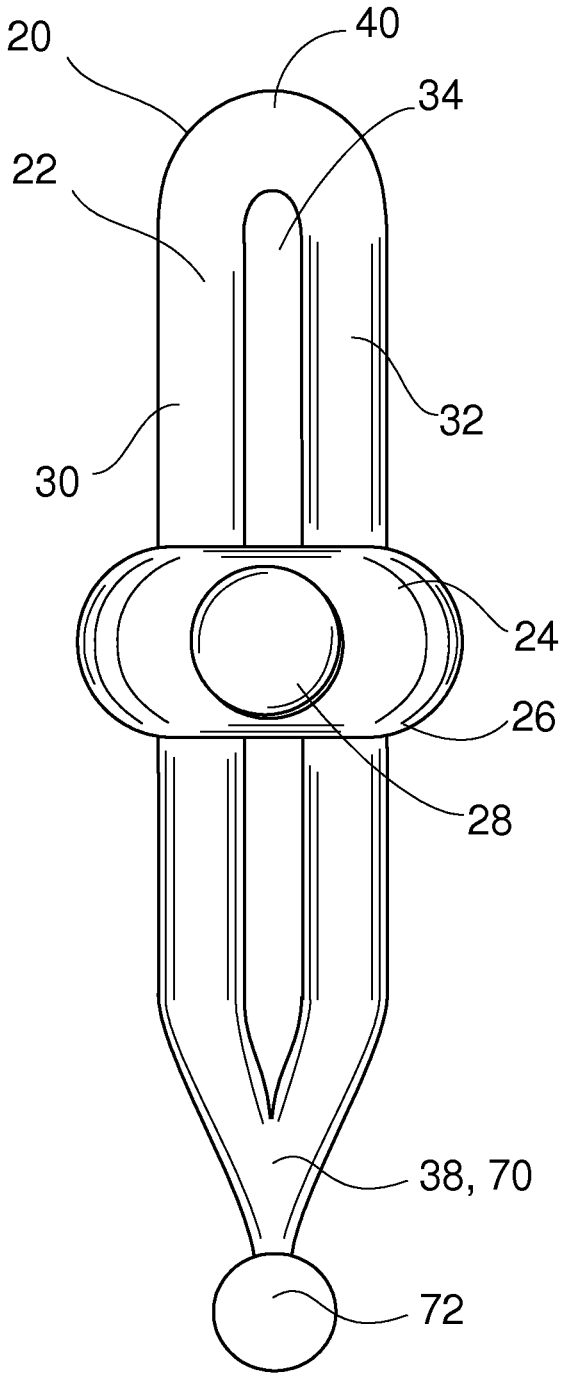
FIG. 5 depicts a pull tie in which the two legs of the pull tie are fused into a narrow bridging member.

FIG. 5 depicts a pull tie 20 similar to those of FIGS. 1A and 1B, except that the bridging element 38 comprises a relatively narrow fused region 70 where the two legs 30, 32 come together. The fused region 70 may be appended, as shown, with a gripping element 72 that may be a disk, a sphere, a textured surface of any shape, or any other structure suitable for grasping, such as by a thumb and a finger of one hand. The gripping element 72 may comprise elastomeric material or substantially non-elastomeric material.

Figure 6:
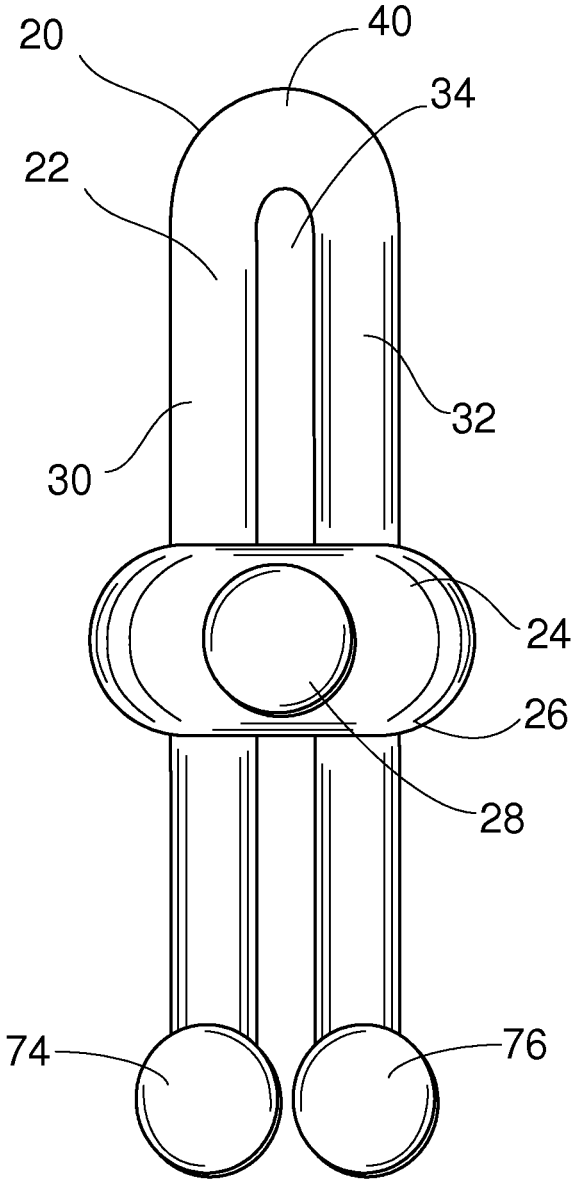
FIG. 6 depicts a pull tie lacking a bridging member in which each of the two legs of an elastomeric cord the pull tie terminate in separate terminal stops.

FIG. 6 depicts a pull tie 20 similar to those of FIGS. 1A and 1B, except that it lacks a bridging element 38 and instead comprises terminal stops 74,76 at the ends of each of the legs 30, 32, respectively, which act to prevent the slidable lock 24 from leaving engagement with the legs 30, 32 of the elastomeric cord 22. The terminal stops 74, 76, which act as lock retention means to retain the slidable lock 24 on the elastomeric cord 22, may be enlarged portions of the elastomeric cord 22 or other structures that are unitary with the elastomeric cord 22, or they may be separately formed, distinct objects that are attached to the legs 30, 32 but not unitary therewith. The terminal stops 74, 76 may also serve as a gripping element to provide a similar function of the gripping element 72 in FIG. 5.

The Elastomeric Cord

The elastomeric cord can have a cross-sectional shape that is circular, elliptical, rectangular, octagonal, or any other desired shape, and need not be uniform in cross-section along its length. The ratio of the maximum cross-sectional area to the minimum cross-sectional area along any region adapted to pass within or be directly contacted by the slidable lock may about 1.1 or greater, such as about 1.3 or greater, 1.5 or greater, 2 or greater, or 3 or greater. The elastomeric cord can also comprise multiple strands and may, for example, be in the form of a multi-strand rope comprising multiple elastomeric strands joined or twisted together.

The elastomeric cord may have a length of from about 10 cm to 50 cm, such as from about 20 cm to about 40 cm, or from about 25 cm to about 35 cm, or about 10 cm or greater. In other versions, particularly for use with objects other than standard plastic bags for consumer use, larger or smaller cord lengths may be considered. The diameter or effective diameter (for non-circular cross-sections, defined as the diameter of a hypothetical circle having the same cross-sectional area as the cord) of the elastomeric cord may generally be from about 1 mm to about 12 mm, such as from about 2 mm to about 10 mm or from about 3 mm to about 8 mm. The elastomeric cord may comprise a single elastomer or a blend of two or more materials, including two or more elastomers, and may be substantially homogeneous or heterogeneous in composition. For example, the elastomeric cord may comprise a rubber cord coated with silicone, or visa versa, or multiple strands or layers of differing materials.

The elastomers may be selected from silicone polymers, natural rubber, synthetic rubbers, polyurethane, Neoprene® (chloroprene, a product of DuPont Performance Elastomers), vinyl polymers, synthetic block copolymers with elastomeric properties such as butadiene copolymers, polyolefins such as metallocene polypropylene or polyethylene, nitrile Buna-N or other copolymers of butadiene and acrylonitrile, carboxylated nitrile polymers or highly saturated nitrile polymers such as HNBR, Varmac (a copolymer of ethylene, methylacrylate and a monomer to facilitate vulcanization), fluoroelastomers such as Viton® (produced by DuPont Performance Elastomers) or Fluorel® (produced by 3M Corporation), and the like.

Silicone polymers may comprise siloxane polymers such as those with substituent vinyl and methyl groups, organoreactive polysiloxanes, etc., including those described in U.S. Pat. No. 7,271,233, "Room-Temperature-Curable Silicone Rubber Composition," issued Sep. 18, 2007 to Yoshitake et al.; U.S. Pat. No. 7,119,143, "Silicone Pads for Electronics Thermal Management," issued Oct. 10, 2006 to Jarnjevic and Eaton; U.S. Pat. No. 4,755,554, "Silicone Rubber Composition," issued Jul. 5, 1988 to Itoh et al.; U.S. Pat. No. 3,639,155, "Dirt-Resistant Silicone Rubber," issued Feb. 1, 1972 to Hartlein and Vincent. Silicone polymers may be reinforced (e.g., with PTFE or other polymeric or non-polymeric materials), comprise particulates and filler materials such as silica, pigments, and the like.

The elastomer may be provided as a coating on an underlying non-elastomeric material such as a string, thread, ribbon, strip of textile, or cord. In some embodiments, the thickness of the elastomeric material in the elastomeric cord (or over at least a portion thereof, said portion being located in a zone that can be engaged by the slidable lock) is at least about 0.5 mm or at least about 1.0 mm over at least a portion of the underlying non-elastomeric material. In some embodiments, the cross-sectional area of an elastomeric cord such as a composite elastomeric cord has a cross-sectional area of about 1 square millimeter or greater, more specifically about 2 square millimeters or greater, and more specifically still about 4 square millimeters or greater. In some embodiments, at least 30% or at least 50% of the cross-section of the cord is occupied by elastomeric material. In related embodiments, a non-elastomeric material may be used as a reinforcing element to reinforce the elastomeric material. The reinforcing element may be elongated (e.g., aspect ration of about 10 or greater) in the form of one or more filaments that may be, for example, polymeric, natural fibers, or metallic filaments.

In one embodiment, the elastomeric cord comprises phosphorescent material to provide a glow-in-the-dark function. Common pigments used in phosphorescent materials include zinc sulfide and strontium aluminate. Glow-in-the-dark pigments can include, for example, zinc sulfide or strontium oxide aluminate-based compounds. Radioluminescent materials may also be used, such as tritium-excited luminous compounds. f The elastomeric cord may be substantially smooth, striated, serrated, etc. In some versions, serrations or other surface irregularities provide steric hindrance to removal of the band. In other versions, the clamping in the slidable lock provides sufficient force and restraint. In other words, normal force pressing on the band holds it in place, resulting in a two-way restraint (band cannot easily slide in either the up or down direction). When a ratchet-like mechanism is in play, a one-way restraint may predominate, meaning that that slide can more easily move in one direction than the other.

The band can interact with the clasp via a ratchet mechanism, wherein angled grooves or serrations in the band engage with an serrated portion of the clasp that contacts the band. Such ratchet mechanisms are described, for example, in the following US patents, each of which is herein incorporated by reference to the extent they are non-contradictory herewith:

U.S. Pat. No. 4,092,765, "Miniaturized Harnessing Device," issued Jun. 6, 1978 to A. W. Joyce, which describes a miniaturized harnessing device formed by a locking head and an attached serrated strap. The head contains a guide channel for receiving the strap after encirclement of the items to be harnessed, and an internal locking tang. The end of the strap before the regular serrations has a serrated ramp, the length of which is longer than the interval between regular serrations, to ease the insertion of the strap into a small-scale harnessing device.

U.S. Pat. No. 3,908,233, "Releasable One-Piece Cable Tie," issued Sep. 30, 1975 to Caveney and Moody, which describes a releasable integral one-piece cable tie to be tensioned about a bundle of wires and the like, the cable tie comprising an elongated flexible strap, a row of teeth disposed on one longitudinal surface of the strap and arranged transversely with respect thereto, a frame integral with one end of the strap and including an abutment wall, the frame having an entry surface and an exit surface and a strap-receiving opening extending therethrough, a pawl disposed within the frame in the strap-receiving opening and hingedly connected thereto, the abutment wall having a strap-bearing surface disposed toward the pawl and defining therewith a strap-receiving throat, a set of transverse teeth on the pawl disposed toward the abutment wall and shaped complementary to the row of teeth on the strap, and an extension on the pawl extending beyond the exit surface in all positions of the pawl for engagement by a user to move the pawl.

U.S. Pat. No. 3,300,825, "Cable Tie and Anchor," issued Jan. 31, 1967 to A. W. Brandt, which describes a wedge-lock band clamp.

Instead of spending the time to twist the wire around the items packaging, this method of sealing freshness of a product and securing it within the packaging may provide much greater ease of use. The method, in general terms, comprises the steps of:

moving the sliding lock to a lower position to provide a large loop between the sliding lock and the bend in the elastomeric cord, the large loop defining an original shape;

opening the large loop with lateral force to increase the width of the opening of the loop to receive an item such as a portion of a flexible bag;

releasing the lateral force to allow the widened large loop to be urged towards its original shape and thereby engaging the item received in the loop;

activating a release means on the slidable lock, such as pressing a depressible plunger that appears as a button on the external surface of the lock, to decrease the clamping of the elastomeric cord and thereby allowing the slidable lock to slide more freely along the elastomeric cord; and sliding the slidable lock toward the bend in the loop to cinch the item received in the loop, thereby increasing the degree of closure experienced by the received item.

The act of sliding the slidable lock after the release means have been activated (e.g., a depressible plunger on the lock has been depressed to decrease the braking force or clamping force imposed on the elastomeric cord) can comprise grasping the lock with one hand the elastomeric cord with the other and causing relative motion such that the lock moves to a new position long the elastomeric cord.

The elastomeric cord may terminate with a bridging member that joins the two legs of the elastomeric cord descending from a bend. The slidable lock is between the bend and the bridging member. The bridging member may be a simple strut joining the ends of the elastomeric cord, or may comprise a bond that joins them together, such as adhesive, a thermal weld, a wire or string wrapped around the two ends to bind them, a pin passing between them, etc. In one version, the bridging member is made of the same material as the elastomeric cord itself and is integral therewith, and may be formed with the cord during molding or extrusion. An integral bridging member may comprise a surface or shape that is readily grasped by fingers, such as a circle or oval loop, a disk, a square, etc.

Alternatively, the elastomeric cord may be provided without a bridging member, but may terminate in unattached ends. To prevent the ends from passing through the slidable lock and thus detaching the slidable lock from the elastomeric cord, the elastomeric cord may terminate in enlarged endings that cannot readily pass through the bore of the body of the slidable lock, or through the passage way between the body and the depressible plunger or other locking elements in the slidable lock. The enlarged endings may be bulbs or balls formed at the end of the cords, knots tied therein, added elements attached to the ends of the cords, etc.

The pull tie and its components, such as the elastomeric cord and slidable lock, are sufficiently resilient and durable that the pull tie may be used many times to secure flexible containers such as plastic bags. For example, a pull tie of some embodiments of the present invention may be used for 50 or more cycles of securing a bag and releasing a bag, or for 100 or more cycled, or 200 or more cycles before being likely to face mechanical failure. Because of its reusable nature, pull ties may be marketed as stand-along items for many uses by a consumer or other parties, or may be sold in combination with plastic bags or other flexible closures suitable for use with the pull tie, or may be provided as a closure already in place securing a flexible container such as a bread bag or other food or non-food item. The pull tie may be marketed as an incentive to purchase a packaged item, a package of flexible closures, or other product.

The Slidable Lock

The slidable lock may comprise plastic, metal, wood, or other materials, and generally comprises a body having two or more plastic components that engage to define a passage way that can receive the elastomeric cord. The slidable lock comprises a release element such as a depressible plunger in the form of a rounded, elevated button on the outer surface of the slidable lock that can be depressed to release the grip of the slidable lock on the elastomeric cord. The plunger can be operably engaged with a spring between the button and a lower internal surface of the body, such that the spring biases the plunger to an upward position that results in force being applied to the elastomeric cord that prevents it from readily slipping in the passageway between the body and the plunger. When the plunger is depressed, the grip on the elastomeric cord is relaxed and the slidable lock can freely slide to a new location.

In one embodiment, the lower portion of the plunger (beneath the exposed surface of the button that may be depressed) has one or two bores therein to receive the elastomeric cord (both legs could fit into one bore, or there may be a bridge between two bores to keep the legs separated). The bores may align with one or more openings in the body of the slidable lock when the plunger is depressed; otherwise, the bores are urged away from being aligned with the one or more openings in the body of the slidable lock, such that when an elastomeric cord passes through the bores and the openings, the cord is pressured by the force being applied to the plunger such that the cord is gripped. In some embodiment, the one or more openings are two openings.

In one embodiment, the bores in the plunger have substantially the same diameter as the elastomeric cord itself and the openings in the body of the slidable lock, such that the shifting of the bores out of alignment with the openings of the body of the slidable lock will tend to make the elastomeric cord follow a non-linear route through the slidable lock wherein frictional forces are applied the prevent sliding of the lock until the plunger is depressed.

A basic slidable lock unit that can be adapted for the present invention is that described in U.S. Pat. No. 4,288,891, "Cord Lock Having Depressible Plunger," issued Sep. 15, 1981 to O. W. Boden, herein incorporated by reference. Boden describes a cord lock having a body containing a plunger which can be pressed inwardly relative to the body against the resistance of an actuating spring, with the body and plunger having apertures or bores through which a cord or cords can extend and which have edges acting to grip the cords when the plunger is in a predetermined locking position. The apertures may be of oblong sectional shape, and the gripping edges of the plunger and body may be sharpened in a relation assuring effective clamping of the cord.

The slidable lock can employ other known cord locks used in lanyards such as Streamlight® Lanyards (e.g., those pictured at http://www.imagometrics.com/FLReviews/FL-_Stuff.htm), or the cord locks described in any of the following: U.S. Pat. Nos. 4,665,590; 4,711,002; 5,208,950; 5,517,729; 5,572,770; 5,697,128; 6,189,186, and 6,675,446.

This is where the majority of discussion takes place

REMARKS

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense.

While the foregoing description makes reference to particular illustrative embodiments, these examples should not be construed as limitations. The inventive system, methods, and devices can be adapted for many other uses not explicitly listed above, and can be modified in numerous ways within the spirit of the present disclosure. All elements shown, for example, may be subject to a wide variety of decorative enhancements and variations in shape, texture, and so forth without departing from the scope of the present invention. Thus, the present invention is not limited to the disclosed embodiments, but is to be accorded the widest scope consistent with the claims below. Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

Having thus described the invention, what is desired to be protected by Letters Patent is presented in the subsequent appended claims.

We claim:

1. A pull tie for releasably closing flexible containers, comprising:

a substantially rigid elastomeric cord formed with a U-shape a bend at one end from which a first leg and a second leg extend, and a slideable lock configured to hold the first and second legs in place and comprising a body having one or more openings to receive the first and second legs, a depressible plunger comprising at least one bore to receive the first and second legs within the body of the slidable lock, and bias means to urge the plunger into a locking position such that the first and second legs are gripped by the slidable lock, wherein depressing the depressible plunger reduces the gripping of the first and second legs by the slidable lock and allows the slidable lock to be moved relative to the first and second legs, wherein the first and second legs are rigid enough to allow the lock to slide to a lower position on the first and second legs, more remote from the bend, wherein the portion of the first and second legs are between the slidable lock and the bend defines a loop that can receive a portion of a flexible container, and wherein when the pull tie is not in use, the first and second legs are straight and parallel to each other, separated by a uniform gap substantially along the first and second legs and, wherein depressing the depressible plunger reduces the gripping of the first and second legs by the slidable lock and allows the slidable lock to be moved along the first and second legs and to slide to an upper position on the first and second legs and through the gap, towards the bend, and the gap remains substantially uniform at the ends of the legs distal from the U-shaped bend.

2. The pull tie of claim 1 wherein the loop has a shape that is substantially maintained regardless of orientation in earth's gravity field.

3. The pull tie of claim 2, wherein the elastomeric cord is a deformable silicone polymer having a width of at least 2 millimeters.

4. The pull tie of claim 1, further comprising a lock retention means attached to the first and second legs of the elastomeric cord to prevent the slidable lock from being readily removed from the elastomeric cord.

5. The pull tie of claim 4, wherein the lock retention means comprises a bridging element.

6. The pull tie of claim 5, wherein the lock retention means comprises enlarged endings of the first and second legs.

7. The pull tie of claim 5, wherein the bridging element is substantially circular and the bridging element is parallel to the loop.

8. The pull tie of claim 1, wherein the pull tie can be opened using both a compressive force and a tension force.

9. The pull tie of claim 7, wherein the pull tie can be closed using both a compressive force and a tension force.

10. A pull tie for releasably closing flexible containers, comprising a substantially rigid elastomeric cord formed in a U-shape bend at one end from which a first leg and a second leg extend, and a slideable lock configured to hold the first and second legs in place and comprising a body having one or more openings to receive the first and second legs, a depressible plunger comprising at least one bore to receive the first and second legs within the body of the slidable lock, and bias means that urge the plunger into a locking position such that the first and second legs is gripped by the slidable lock, wherein depressing the depressible plunger reduces the gripping of the first and second legs by the slidable lock and allows the slidable lock to be moved relative to the first and second legs, wherein a portion of the first and second legs between the slidable lock and the bend defines a loop that can receive a portion of a flexible container, wherein a maximum loop size is at least 5 centimeters in length and has a shape that is substantially maintained regardless of orientation in earth's gravity field, and wherein when the pull tie is not in use, the first and second legs are straight and parallel to each other, separated by a uniform gap substantially along the first and second legs and, wherein depressing the depressible plunger reduces the gripping of the first and second legs by the slidable lock and allows the slidable lock to be moved along the first and second legs and to slide to an upper position on the first and second legs and through the gap, towards the bend, and the gap remains substantially uniform at the ends of the legs distal from the U-shaped bend.

11. The pull tie of claim 10, where the bias means comprise a spring operably associated with the body of the slidable lock and the depressible plunger.

12. The pull-tie of claim 10, wherein the elastomeric cord has a cross-sectional area of about 2 square millimeters or greater.

13. The pull-tie of claim 10, wherein the elastomeric cord has a cross-sectional area of about 4 square millimeters or greater.

14. The pull tie of claim 10, wherein the elastomeric cord further comprises an elongated reinforcing element.

15. The pull tie of claim 14, wherein the reinforcing element is non-elastomeric, and wherein a cross-section of the elastomeric material of the elastomeric cord has a cross-sectional area of about 1 square millimeter or greater.

16. The pull tie of claim 14, wherein at least 30% of the cross-sectional area of the elastomeric cord in a region adapted for engagement with the slidable lock is occupied by elastomeric material.

17. The pull tie of claim 14, wherein at least 50% of the cross-sectional area of the elastomeric cord in a region adapted for engagement with the slidable lock is occupied by elastomeric material.

18. The pull tie of claim 10, wherein the elastomeric cord comprises a phosphorescent material.

19. The pull tie of claim 10, wherein the pull tie is sufficiently durable for at least about 50 cycles of use in each of which a flexible container is secured with the pull tie and then released.

* * * * *